US009521891B2

(12) United States Patent
Ragosta et al.

(10) Patent No.: US 9,521,891 B2
(45) **Date of Patent: *Dec. 20, 2016**

(54) HAIR STYLING TOOL WITH ROTATABLE CYLINDER

(71) Applicant: MM&R Products, Inc., Calabasas, CA (US)

(72) Inventors: Michael A. Ragosta, Calabasas, CA (US); Bruno Meglio, Beverly Hills, CA (US); Claudio Marino, Woodland Hills, CA (US); David Richmond, Culver City, CA (US); Howard Richmond, Los Angeles, CA (US)

(73) Assignee: MM&R Products, Inc., Calabasas, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/975,672

(22) Filed: Dec. 18, 2015

(65) Prior Publication Data

US 2016/0100664 A1 Apr. 14, 2016

Related U.S. Application Data

(63) Continuation of application No. 14/794,736, filed on Jul. 8, 2015, now Pat. No. 9,259,069, which is a (Continued)

(51) Int. Cl.
*A45D 2/12* (2006.01)
*A45D 7/02* (2006.01)
(Continued)

(52) U.S. Cl.
CPC . *A45D 7/02* (2013.01); *A45D 1/04* (2013.01); *A45D 2/001* (2013.01); *A45D 2/002* (2013.01);
(Continued)

(58) Field of Classification Search
CPC ..... A45D 1/04; A45D 1/06; A45D 1/18; A45D 2/02; A45D 2/001; A46B 13/02
(Continued)

(56) References Cited

U.S. PATENT DOCUMENTS 54,695 A 5/1866 Crosman
185,789 A 12/1876 Smith
(Continued)

FOREIGN PATENT DOCUMENTS

CH 594382 A5 1/1978
DE 1062212 B 7/1959
(Continued)

OTHER PUBLICATIONS

USPTO, Office Action issued in Marino et al., U.S. Appl. No. 12/270,091 on Jun. 18, 2009.
(Continued)

*Primary Examiner* — Todd E Manahan
*Assistant Examiner* — Brianne Kalach
(74) *Attorney, Agent, or Firm* — Laura M. Lloyd; Leech Tishman Fuscaldo & Lampl

(57) ABSTRACT

A hair styling tool includes a body, a cylinder extending from the body, the cylinder rotatable relative to the body, a motor for rotating the cylinder, a heater to heat the cylinder, and a styling arm pivotally attached to the body. The hair styling tool may have a generally clam shell configuration, wherein the styling arm is movable between an open position in which the styling arm is distant the cylinder and a closed position in which the styling arm is proximate to the cylinder, such as contacting the cylinder. The styling arm may also include a brush head with fixed or retractable bristles and/or a smoothing plate.

32 Claims, 18 Drawing Sheets

Related U.S. Application Data continuation of application No. 14/040,141, filed on Sep. 27, 2013, now Pat. No. 9,107,485, which is a continuation of application No. 13/707,414, filed on Dec. 6, 2012, now Pat. No. 8,567,416, which is a continuation of application No. 12/690,834, filed on Jan. 20, 2010, now Pat. No. 8,342,191, which is a continuation of application No. 12/611,849, filed on Nov. 3, 2009, now Pat. No. 8,360,076, which is a continuation of application No. 12/270,091, filed on Nov. 13, 2008, now Pat. No. 7,631,646, which is a continuation-in-part of application No. 11/678,559, filed on Feb. 23, 2007, now Pat. No. 7,481,228.

(60) Provisional application No. 60/776,476, filed on Feb. 24, 2006.

(51) Int. Cl.

| | |
|---|---|
| ***A45D 1/04*** | (2006.01) |
| ***A45D 2/00*** | (2006.01) |
| ***A46B 7/02*** | (2006.01) |
| ***A46B 9/02*** | (2006.01) |
| ***A46B 13/02*** | (2006.01) |
| ***A45D 2/02*** | (2006.01) |

(52) U.S. Cl.
CPC ..... *A45D 2/02* (2013.01); *A46B 7/023* (2013.01); *A46B 9/023* (2013.01); *A46B 13/02* (2013.01); *A46B 2200/104* (2013.01)

(58) Field of Classification Search
USPC ..... 132/226–227, 229, 232–234, 237–239,132/241
See application file for complete search history.

(56) References Cited

U.S. PATENT DOCUMENTS

| | | | | |
|---|---|---|---|---|
| 431,497 | A | | 7/1890 | Walker |
| 524,654 | A | | 8/1894 | Shute |
| 1,572,161 | A | | 2/1926 | Russell |
| 1,857,689 | A | | 5/1932 | Melkman |
| 3,019,463 | A | | 2/1962 | Mitchell |
| 3,431,571 | A | | 3/1969 | Kraus |
| 3,890,984 | A | | 6/1975 | Lesetar et al. |
| 3,909,868 | A | | 10/1975 | Nogues et al. |
| 3,947,910 | A | | 4/1976 | Akerman |
| 4,023,578 | A | | 5/1977 | Buhler |
| 4,084,282 | A | | 4/1978 | Calvert et al. |
| 4,145,600 | A | | 3/1979 | Walter et al. |
| 4,161,050 | A | | 7/1979 | Sasaki et al. |
| 4,197,608 | A | | 4/1980 | Holley |
| 4,233,999 | A | | 11/1980 | Thomas |
| 4,250,902 | A | | 2/1981 | Ihara |
| 4,335,732 | A | | 6/1982 | Megna |
| 4,442,849 | A | | 4/1984 | Kawabe |
| 4,492,241 | A | | 1/1985 | Thaler et al. |
| 4,591,695 | A | | 5/1986 | Inoue |
| 4,619,012 | A | | 10/1986 | Wachtel |
| 4,829,156 | A | * | 5/1989 | Thompson ..... A45D 1/04 132/232 |
| 4,910,381 | A | | 3/1990 | Reichle |
| 5,268,988 | A | | 12/1993 | Miyamoto et al. |
| 5,494,058 | A | | 2/1996 | Chan et al. |
| 5,584,088 | A | | 12/1996 | Pauldine |
| 5,660,191 | A | | 8/1997 | Bontoux et al. |
| 5,837,972 | A | | 11/1998 | Padilla |
| 6,070,594 | A | | 6/2000 | Mears |
| 6,070,596 | A | | 6/2000 | Altamore et al. |
| 6,098,635 | A | | 8/2000 | Marino et al. |
| 6,158,073 | A | | 12/2000 | Jiovanni et al. |
| D439,051 | S | | 3/2001 | White |
| 6,237,183 | B1 | | 5/2001 | Fischer |
| D465,654 | S | | 11/2002 | Richmond et al. |
| D466,693 | S | | 12/2002 | Richmond et al. |
| D471,364 | S | | 3/2003 | Kwong |
| D489,482 | S | | 5/2004 | Cho |
| D504,977 | S | | 5/2005 | Caicedo |
| 6,895,975 | B2 | | 5/2005 | Hafemann |
| 6,941,955 | B2 | | 9/2005 | Yao |
| D516,242 | S | | 2/2006 | Habibi |
| 7,040,021 | B2 | | 5/2006 | Talavera |
| 7,045,744 | B2 | | 5/2006 | Oh |
| 7,264,004 | B2 | | 9/2007 | Djulbegovic |
| 7,341,064 | B2 | | 3/2008 | Habibi |
| 7,478,640 | B2 | | 1/2009 | Saida et al. |
| 7,481,228 | B2 | | 1/2009 | Ragosta et al. |
| 8,230,868 | B2 | | 7/2012 | Choi |
| 2005/0016557 | A1 | | 1/2005 | Fasan |
| 2005/0061352 | A1 | | 3/2005 | Yao |
| 2005/0236009 | A1 | | 10/2005 | Park |
| 2006/0196523 | A1 | | 9/2006 | Choi |
| 2006/0237418 | A1 | | 10/2006 | Bousfield et al. |
| 2006/0278251 | A1 | | 12/2006 | Hur |
| 2007/0033754 | A1 | | 2/2007 | Diamond |
| 2007/0089760 | A1 | | 4/2007 | Evanyk |
| 2007/0199574 | A1 | | 8/2007 | Ragosta et al. |
| 2008/0066775 | A1 | | 3/2008 | Mason |
| 2009/0019653 | A1 | | 1/2009 | Diamond |

FOREIGN PATENT DOCUMENTS

| | | | | |
|---|---|---|---|---|
| DE | 2649565 | A1 | | 5/1978 |
| DE | WO02058503 | | | 8/2002 |
| EP | 53942 | | | 6/1982 |
| EP | 315107 | A2 | | 5/1989 |
| FR | 2276794 | A1 | | 1/1976 |
| FR | 2397170 | A1 | | 2/1979 |
| JP | S59-64005 | | * | 4/1984 |
| JP | S62164406 | | | 7/1987 |
| JP | 62295605 | | | 12/1987 |
| JP | H4125726 | | | 11/1992 |
| JP | 6209815 | | | 8/1994 |
| JP | S63125901 | | | 5/1998 |
| JP | 2001104036 | A | | 4/2001 |
| JP | 2005080850 | | | 3/2005 |
| JP | 2005237803 | | * | 9/2005 |
| JP | 2005237803 | A | | 9/2005 |
| JP | 2007175470 | A | | 7/2007 |
| JP | S5964005 | | | 6/2013 |
| KR | 20010001881 | | | 1/2001 |
| KR | 300274597 | | | 5/2001 |
| KR | 20020021561 | | | 3/2002 |
| KR | 300306635 | | | 9/2002 |
| KR | 200367464 | Y1 | | 11/2004 |
| KR | 1020050003958 | A | | 1/2005 |
| KR | 1020050028696 | A | | 3/2005 |
| KR | 200394529 | Y1 | | 9/2005 |
| KR | 100527106 | B1 | | 11/2005 |
| KR | 100529998 | B1 | | 11/2005 |
| KR | 100546084 | B1 | | 1/2006 |
| KR | 100553133 | B1 | | 2/2006 |
| KR | 1020060132060 | A | | 12/2006 |
| KR | 8912446 | | | 6/2013 |

OTHER PUBLICATIONS

USPTO, Office Action issued in Marino et al., U.S. Appl. No. 12/270,091 on Oct. 5, 2009.
USPTO, Office Action issued in Ragosta et al. U.S. Appl. No. 13/129,246 on Jul. 31, 2012.
USPTO, Office Action issued in Ragosta et al. U.S. Appl. No. 12/611,849 on Feb. 2, 2011.
USPTO, Office Action issued in Ragosta et al. U.S. Appl. No. 12/611,849 on Oct. 31, 2011.
USPTO, Office Action issued in Ragosta et al. U.S. Appl. No. 12/611,849 on Feb. 14, 2012.
USPTO, Office Action issued in Ragosta et al. U.S. Appl. No. 12/611,849 on Sep. 12, 2012.
USPTO, Office Action issued in Richmond et al. U.S. Appl. No. 12/690,834 on Feb. 3, 2011.

(56) References Cited

OTHER PUBLICATIONS

USPTO, Office Action issued in Richmond et al. U.S. Appl. No. 12/690,834 on Nov. 4, 2011.
USPTO, Office Action issued in Richmond et al. U.S. Appl. No. 12/690,834 on Feb. 15, 2012.
USPTO, Office Action issued in Richmond et al. U.S. Appl. No. 12/690,834 on Sep. 13, 2012.
USPTO, Office Action issued in Ragosta et al. U.S. Appl. No. 13/707,414 on Apr. 12, 2013.
USPTO, Office Action issued in Ragosta et al. U.S. Appl. No. 13/707,414 on Jun. 18, 2013.
USPTO, Office Action issued in Ragosta et al. U.S. Appl. No. 14/040,141 on Jan. 16, 2014.
USPTO, Office Action issued in Ragosta et al. U.S. Appl. No. 14/040,141 on Mar. 17, 2015.
USPTO, Office Action issued in Ragosta et al. U.S. Appl. No. 11/678,559 on Jul. 24, 2008.
USPTO, Office Action issued in Ragosta et al. U.S. Appl. No. 11/678,559 on Aug. 28, 2008.
Decision on Confirmation-of-scope trial (non-infringement) for Korean Patent No. 1065441, Aug. 1, 2013.
*Tre Milano* v. *Stitch n' Genius, Inc.*, Complaint for Patent Infringement; Copyright Infringement; Unfair Competiton; and False Advertising, Apr. 20, 2009, Civil Action CV09-2727 VBT (RCx) (C.D. California).
*Tre Milano* v. *Stitch n' Genius, Inc*, Answer, May 11, 2009, Civil Action CV09-2727 VBT (RCx) (C.D. California).
*Tre Milano, LLC and MM&R Products Incorporated* vs. *Conair Corporation and DOES 1-10*; Complaint for: Infringement and Statutory Unfair Competition; 100 pages; Apr. 10, 2014.
*Tre Milano, LLC and MM&R Products Incorporated* vs. *Conair Corporation and DOES 1-10*; Conair Corporation's Counterclaim—Demand for Trial Jury; 12 pages; Oct. 27, 2014.
*Tre Milano, LLC and MM&R Products Incorporated* vs. *Conair Corporation and DOES 1-10*; Conair Corporation's Counterclaim—Demand for Trial; 6 pages; Oct. 27, 2014.
*Tre Milano, LLC and MM&R Products Incorporated* vs. *Conair Corporation and DOES 1-10*; Joint Report Pursuant to Federal Rule of Civil Procedure 16(b)/26(f) and Local Rule 26-1; 13 pages; Oct. 30, 2014.
Stitch 'n Genius, Request for Ex Parte Reexamination, U.S. Pat. No. 7,481,228, May 9, 2009.
*MM&R Products, Inc.* v. *Stitch N' Genius*, U.S.D.C. Central District CV09-4082 VBF (RCx), Defendants' Invalidity Contentions, Oct. 5, 2009.
*MM&R Products, Inc.* v. *Stitch N'Genius, Inc.*, U.S.D.C., Central District, CV09-4082 SVW (Ex), Complaint, Jun. 8, 2009.
*MM&R Products, Inc.* v. *Stitch N'Genius, Inc.*, U.S.D.C., Central District, CV09-4082 SVW (Ex), Answer with Dounterclaims, Jul. 13, 2009.
*MM&R Products, Inc.* v. *Stitch N'Genius, Inc.*, U.S.D.C., Central District, CV09-4082 SVW (Ex), Counterclaims, Jul. 14, 2009.
*MM&R Products, Inc.* v. *Stitch N'Genius, Inc.*, U.S.D.C., Central District, CV09-4082 SVW (Ex), First Amended Counterclaims, Jul. 21, 2009.
*MM&R Products, Inc.* v. *Stitch N' Genius*, U.S.D.C. Central District CV09-4082 VBF (RCx), Second Amended Counterclaims, Oct. 5, 2009.
Internet papers: http:www.folica.com/Most_Revie_579_1.html; Folica.com Beauty Product Reviews.
U.S. Appl. No. 90/010,534, Order Granting Ex Parte Reexamination, Jun. 24, 2009.
"Notice of Allowability," issued Dec. 8, 2008, for Ragosta et al., U.S. Appl. No. 11/678,559.
Stipulated Request for Dismissal of All Claims Against Sally Beauty Supply, LLC, a Delaware Limited Liability Company; Demand Industries, Inc. dba Server Central Network, an Ilinois Corporation, Without Prejudice, filed in *MM&R, Inc. and Tre Milano, LLC* v. *Sally Beauty Supply, LLC et al.*
Order Granting Stipulated Request for Dismissal of All Claims Against Sally Beauty Supply, LLC, a Delaware Limited Liability Company; Demand Industries, Inc. dba Server Central Network, an Illinois Corporation, Without Prejudice, filed in *MM&R, Inc. and Tre Milano, LLC* v. *Sally Beauty Supply, LLC et al.*
Order Granting Request for Dismissal of All Claims Against Sally Beauty Supply, LLC, a Delaware Limited Liability Company; Demand Industries, Inc., dba Server Central Network, an Illinois Corporation, Without Prejudice, filed in *MM&R, Inc. and Tre Milano, LLC* v. *Sally Beauty Supply, LLC et al.*
Order Granting Stipulated Request for Dismissal of All Claims Against Hair Tech, Inc., a Georgia Corporation dba Hair Tech International, Inc., Without Prejudice, filed in *MM&R, Inc. and Tre Milano, LLC* v. *Sally Beauty Supply, LLC et al.*
USPTO Office Communication 11/678,559 dated Jul. 24, 2008.
International Search Report and Written Opinion dated Jun. 7, 2010.
International Search Report dated Aug. 19, 2010.
Internet papers: http://www.folica.com/Most/Revie_59_1.html; Folica.com Beauty Product Reviews.
English translation of JP 62-295605.
English translation of JP H3-30863.
English translation of WO2002/058503 A1.
English translation of FR 2397170 A1.
English translation of JP S63-125901.
English translation of JP 2005-80850.
Machine Translation of JP 2005-237803.
Machine Translation of JP 63-125901.
Petition for Korean Invalidity Proceeding for Claims 1-12 and 15-26.
Korean Preliminary Injunction Proceeding Defendant's Response Brief.
Petition for Korean Scope Trial (3288).
Korean Scope Ruling (3288).
Petition for Korean Scope Trial (3261).
Korean Scope Trial (3261).
Korean Preliminary Injunction Proceeding Defendant's Second Response Brief.
Korean Scope Trial (3261), Claimant's Response.
Korean Scope Trial (3288), Claimant's Response.
Korean Invalidity Proceeding Claims 1-12 and 15-26, Claimant's Response.
Korean Invalidity Proceeding for Claims 1-12 and 15-26, Claimant's further Response.
Trial Decision—Invalidation of Korean Patent No. 1065441, Aug. 1, 2013.

* cited by examiner

HAIR STYLING TOOL WITH ROTATABLE CYLINDER

CROSS-REFERENCE TO RELATED APPLICATIONS

This application is a continuation of U.S. patent application Ser. No. 14/794,736 titled "Hair Styling Tool With Rotatable Cylinder" filed Jul. 8, 2015, which is a continuation of U.S. patent application Ser. No. 14/040,141 titled "Hair Styling Tool With Rotatable Cylinder" filed Sep. 27, 2013, now U.S. Pat. No. 9,107,485, which is a continuation of U.S. patent application Ser. No. 13/707,414 filed Dec. 6, 2012, now U.S. Pat. No. 8,567,416, which is a continuation of U.S. patent application Ser. No. 12/690,834 filed Jan. 20, 2010, now U.S. Pat. No. 8,342,191, which is a continuation of U.S. patent application Ser. No. 12/611,849 filed Nov. 3, 2009, now U.S. Pat. No. 8,360,076, which is a continuation of U.S. patent application Ser. No. 12/270,091 filed Nov. 13, 2008, now U.S. Pat. No. 7,631,646, which is a continuation-in-part of U.S. patent application Ser. No. 11/678,559 filed Feb. 23, 2007, now U.S. Pat. No. 7,481,228, which claims the benefit of U.S. Provisional Patent Application No. 60/776,476, filed on Feb. 24, 2006, the contents of which are incorporated in this disclosure by reference in their entirety.

FIELD OF THE INVENTION

This invention relates to a hair styling tool, and more specifically, to a hair styling tool allowing a user to more efficiently and more effectively brush hair and also to more effectively style hair.

BACKGROUND OF THE INVENTION

Brushing hair pulls oil from the scalp region and spreads it throughout the hair, adding body and sheen to the hair and keeping the hair healthy. To add even more body or to style hair in particular shapes, many people blow dry their hair as they brush it. When simultaneously blow drying and brushing hair, desirable results are achieved by pulling the bristles of a hair brush through the hair while heat, such as in the form of hot air, is applied directly to the hair. One method of brushing involves partially rotating the brush so that the bristles move through the hair. A user can usually rotate a brush about one half turn manually and, after each half turn, the user pulls the brush from the hair. The brush is then replaced in a new location, usually adjacent to the preceding location, and the process is repeated. Various brushes have been developed as an improved hair brushing means. Exemplary embodiments of such a brush are described in U.S. Pat. No. 6,098,635 to Marino, the entire content of which is incorporated herein by reference.

Accomplishing rotation evenly over all regions of the scalp is difficult because it is unnatural for a user to rotate his or her hand to the necessary positions. Specifically, blow drying one's own hair requires reaching around the head with the arms raised and providing the proper twist or rotation to the brush is very difficult in that position. Coordinating brush movement while aiming the dryer adds to the difficulty. Barbers and hair stylists can accomplish these positions more easily because they can move relative to a person's head.

In addition to brushing hair, it is often desirable to style one's hair in a particular manner, such as curling straight hair or straightening curly hair. Usually, a separate apparatus in addition to a brush is necessary to curl, straighten, or otherwise style the hair.

SUMMARY OF THE INVENTION

In one exemplary embodiment, a hair styling tool is provided including a body, a cylinder extending from the body, the cylinder rotatable relative to the body, a motor for rotating the cylinder, and a styling arm attached to the body. The styling is movable between an open position in which the styling arm is distant from the cylinder and a closed position in which the styling arm is proximate to the cylinder. The term "proximate" means styling arm is close to the cylinder or in contact with the cylinder. Optionally there is a spacing means between the styling arm and the cylinder so that in the closed position the styling arm does not overload the motor, preferably by preventing the styling arm from contacting the cylinder. The spacing means can comprise a projection on the styling arm that engages a detent in the body. Alternatively, the spacing means can comprise a projection on the body to engage a detent in the spacing arm. The styling arm may include a brush head and/or a smoothing plate. In one exemplary embodiment, the hair styling tool may have a hinged or clam shell configuration.

A brush head of the hair styling tool may include a brush head housing, a smoothing plate housed within the brush head housing and a blade on which bristles are formed, the blade located between the housing and the smoothing plate. The bristles may be movable between an extended position in which the bristles protrude past the smoothing plate and a collapsed position in which the bristles are retracted with respect to the smoothing plate. The brush head housing may also include a bristle release knob, wherein the bristle release knob is adapted to contact the blade to maintain the blade in the extended position and wherein the bristle release knob is movable to be spaced from the blade to permit the blade to be placed in the collapsed position with the bristles retracted.

The hair styling tool may further include a heater adapted to heat the cylinder. The cylinder may have surface holes to dissipate heat and may include grooves or other types of indentations to provide additional friction between the cylinder and the brush head or smoothing plate.

In one exemplary embodiment, the blade is removable from the brush head and replaceable with one of a plurality of different blades having, for example, varying bristle patterns, densities and lengths or having no bristles at all. Additionally, in another exemplary embodiment, the brush head is removable and replaceable with one of a plurality of different brush heads.

The brush head can have a removable blade, from which the bristles extend, that allows for a plurality of interchangeable blades for the user to style their hair, each blade having a different bristle configuration. The smoothing plate can be between two sets of bristles, wherein at least some of the bristles extend beyond the smoothing plate. The smoothing plate preferably has a concave surface curved the same degree as the cylinder.

A spring can be used for biasing the styling arm into the open position. A switch can be used to activate the motor to rotate the cylinder when the styling arm is moved toward the closed position from the open position.

In one version of the invention, the cylinder can rotate relative to the body in both a clockwise direction and a counterclockwise direction. In this version the tool can have a detector for detecting the direction of movement of the styling arm along a user's hair. The detector communicates with the motor to rotate the cylinder in the direction of movement of the styling arm along the user's hair. The detector is adapted to cause the motor to rotate the cylinder in a direction such that the cylinder at its 3 o'clock position has a motion vector in substantially the same direction as movement of the styling arm along the user's hair. An exemplary detector comprises a direction sensor for sensing the direction of movement of the styling arm along a user's hair, an actuator coupled to the direction sensor and movable between a first position corresponding to clockwise rotation of the cylinder and a second position corresponding to counterclockwise rotation of the cylinder and a position sensor for sensing the position of the actuator.

The present invention also includes a method to style a person's hair using the hair styling tool, by the steps of: allowing the heater to heat the cylinder; placing the hair between the cylinder and the styling arm near the scalp with the styling arm in its open position; moving the styling arm to its closed position and causing the switch to activate the motor to rotate the cylinder; and while the cylinder is rotating, pulling the tool toward the tips of the hair, thereby styling the hair.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1:
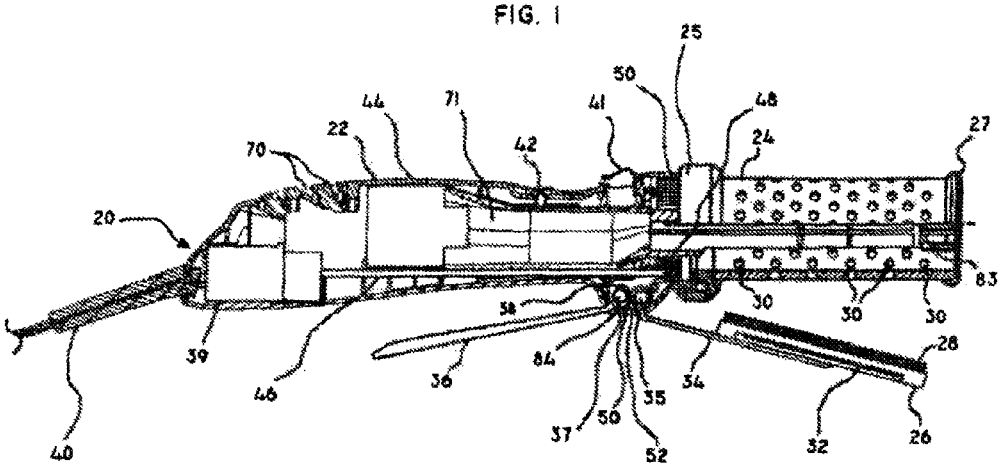
FIG. 1 is a partial cross-section, side elevation view of an exemplary hair styling tool of the present invention having a rotatable cylinder and a movable styling arm.

Referring to FIG. 1, a hair styling tool 20 includes an elongated body 22. The specific dimensions of the body are not critical, but the body should generally allow a user to comfortably hold the hair styling tool during use. In one exemplary embodiment, the body 22 may be adapted to house other mechanical and electrical components of the hair styling tool 20, as described in more detail below.

Figure 2:
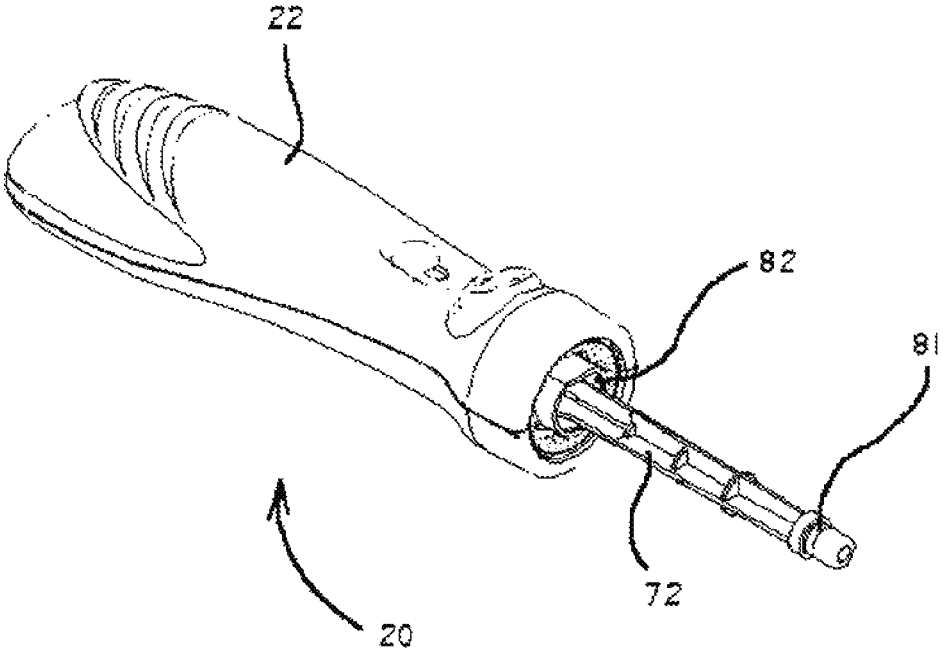
FIG. 2 is a semi-schematic perspective view of an exemplary hair styling tool of the present invention with the rotating cylinder removed.

With reference also to FIG. 2, in one exemplary embodiment of the hair styling tool 20, a mounting channel 72 extends from a distal end of the body 22. As used herein, "distal" shall generally refer to a position or direction away from a base of the body 22 or towards a tip of the mounting channel 72. Conversely, "proximal" shall generally refer to a position or direction toward the base of the body 22 or away from the tip of the hot air channel 72. As described in more detail below, the mounting channel 72 serves to provide additional support to a cylinder 24 rotatably mounted on the mounting channel.

Referring again to FIG. 1, in one exemplary embodiment, a hot air channel 71 may be connected to a hot air fan assembly 44 housed in the body 22 such that hot air provided by the hot air fan assembly travels through the body via the hot air channel. Intake ports 70 in the body 22 admit outside air to an inlet of the hot air fan assembly 44. An opening 82 at a distal end of the hot air channel 71 allows the air to escape the body 22 and enter, for example, a cylinder attached to a distal end of the body as described below. A hot air switch 42 electrically connected to the hot air fan assembly 44 allows a user to control the hot air supply provided by the hot air fan assembly.

An elongated hollow cylinder 24 may be rotatably mounted over the mounting channel 72. The mounting channel 72 may include a groove 81 into which teeth 83 protruding from a cap 27 of the cylinder 24 may be snapped to mount the cylinder to the mounting channel. A base 25 of the cylinder may be adapted to be connected to a distal portion of the body 22. In one exemplary embodiment, the base 25 of the cylinder 24 is connected to the body 22 by a slip fit. In one exemplary embodiment, teeth (not shown) on an inner circumference of the base 25 mesh with teeth on a cylinder drive gear 50 at a distal end of the body 22 to align the cylinder 24 to the body. A distal end of the cylinder 24 may include the cap 27 to seal the distal end of the cylinder and prevent, for example, hot air provided through the hot air channel 71 from escaping from the distal end of the cylinder. The cap 27 may contain teeth 83 to allow the cylinder to be mounted and secured by an interference fit to the mounting channel 72 as described above. The specific shape or dimensions of the cap 27 are not critical as long as the cap substantially covers the distal end of the cylinder 24 and prevents a significant amount of air from escaping from the distal end.

In one exemplary embodiment, the cylinder 24 includes a plurality of holes 30 which allow a flow of hot air from the hot air channel 72 to an exterior of the hair styling tool 20 and to contact hair adjacent the cylinder. In one exemplary embodiment, the holes 30 are circular and arranged in rows, evenly spaced throughout the cylinder 24. The even spacing of the holes 30 throughout the cylinder 24 allows for even distribution of hot air throughout the cylinder and also for uniform heating of the cylinder, thus providing uniform drying when the cylinder is applied to hair, as described in more detail below. Although one configuration of the holes 30 is described herein, the specific configuration of the holes is not critical, and the holes may be arranged in any configuration allowing hot air to travel from the hot air channel 72 through the cylinder 24. Additionally, although the described holes 30 are circular, the shape of the holes is not critical. The holes 30 also serve to increase the friction between the brush head housing and the cylinder, increasing the brushing effectiveness on the hair.

Figure 3A:
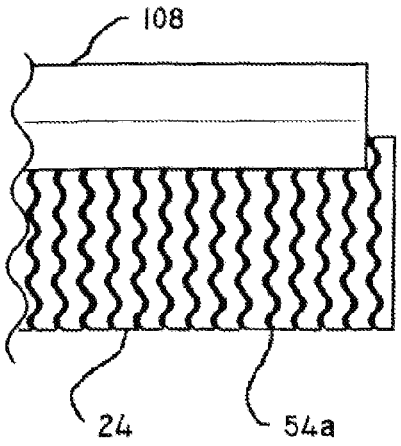
FIGS. 3A, 3B, 3C and 3D are schematic side views of exemplary smoothing plates and cylinders of the present invention.
Figure 3B:
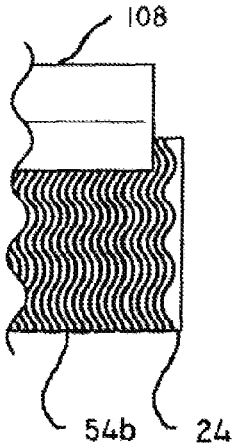
Figure 3C:
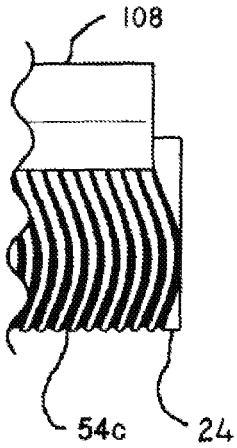
Figure 3D:
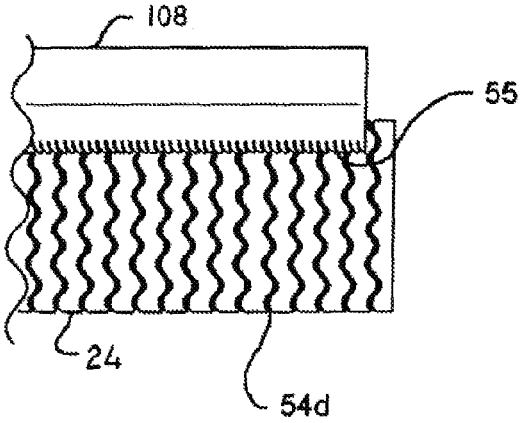

With reference to FIGS. 3A-3D, alternate exemplary surface patterns of the cylinder 24 are shown. The alternate surface patterns, which are generally wave-shaped grooves 54*a*, 54*b*, 54*c*, 54*d*, allow for varying friction along the cylinder's surface to provide different styling options when hair is placed between the cylinder 24 and a smoothing plate 108 as described in more detail below. The grooves may also be used on a cylinder 24 having holes 30 (holes not shown for clarity). With reference to FIG. 3D, the smoothing plate 108 adapted to contact the cylinder 24 may include grooves 55 to further increase the friction between the brush head housing and the cylinder.

The rotation assembly of the hair styling tool 20 will now be described with further reference to FIG. 1. An electric motor 39 may be housed within the body 22, the motor being adapted to rotate the cylinder 24. In one exemplary embodiment, the motor powers a drive shaft 46 which extends along a length of the body 22. A drive gear 48 may be located at a distal end of the drive shaft 46, the drive gear adapted to interact with the cylinder gear drive 50 such when the drive gear 48 is rotated by the drive shaft, the cylinder gear drive 50 rotates as well. When the cylinder 24 interfaces with the cylinder gear drive 50, the cylinder rotates in the same direction and at the same rate as the cylinder gear driver. In one exemplary embodiment, the electric motor 39 is adapted to power the drive shaft 46 at different rates, depending on a setting adjusted by a user.

In one exemplary embodiment, the electric motor 39 is reversible such that it can rotate the drive shaft 48 in either direction. A rotation direction switch 41 may be electrically connected to the motor 39 to allow the direction of the motor to be set by a user. The motor 39 may be powered by, for example, electricity from an electrical power cord 40, a rechargeable battery, or by other means sufficient to generate enough energy to power the motor. An activation switch 38 may be used to activate the motor 39 to drive rotation of the cylinder 24. The activation switch 38 may be located anywhere on the brush, but in exemplary embodiment, the rotation switch is located in a position such that it is activated when a pivot handle 36 is in a closed position, as described in more detail below. Although a specific system including gears is described to allow the motor 39 to rotate the cylinder 24, one of ordinary skill in the art will appreciate that many other similar configurations of the driving system will achieve the same result in substantially the same way.

An elongated styling arm may be attached to the body 22 of the hair styling tool 20. In one exemplary embodiment, the styling arm may be a brush head 26. The brush head 26 may include an array of bristles 28 mounted on a surface of the brush head and protruding toward an outer surface of the cylinder 24. The brush head 26 may also include vent holes 32 to allow hot air to enter or hot air and/or steam to escape to prevent the brush head from becoming dangerously hot. An exemplary brush head 26 venting pattern is shown in FIG. 4.

Figure 4:
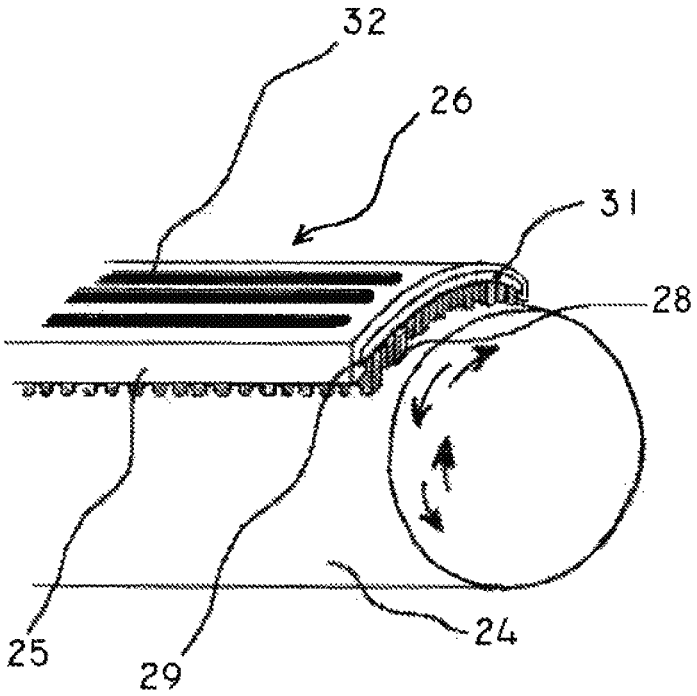
FIG. 4 is a semi-schematic perspective view of an exemplary distal end of the hair styling tool of FIG. 1.

In one exemplary embodiment, as shown in FIG. 4, the brush head 26 has a concave structure such that the brush head generally conforms to the curvature of the cylinder 24, maximizing the effective brushing surface. In a further exemplary embodiment, the brush head 26 may have a width such that it extends around part of the cylinder circumference to subtend an angle between about 20° and about 45°. The brush head 26 may be adapted to receive and secure an interchangeable bristle blade 31, allowing users to choose from a variety of blades having, for example, different widths, different bristle densities and different bristle textures. The brush head 26 may include a groove 29 located along each interior side of the brush head, the grooves 29 adapted to slidingly receive and secure the interchangeable bristle blade 31.

With reference again to FIG. 1, the brush head 26 may be pivotally or otherwise movably attached to the body 22. More specifically, the brush head 26 may be attached to a distal end of a lever arm 34, the lever arm being pivotally attached to the body 22 by, for example, a transverse brush head pivot pin 35. The brush head 26 may have an open position wherein the brush head 26 is spaced from the cylinder 24, and a closed position (FIG. 5) wherein the brush head 26, and specifically, the bristles 28, are proximate to the cylinder, including optionally by contacting the cylinder. A bias means 84, such as a spring, may bias the brush head 26 into an open position. The pivot handle 36 may be provided to allow a user to move the brush head 26 from the open position to the closed position, the pivot handle being pivotally attached to the body 22 by a pivot handle pivot pin 37. In one exemplary embodiment, a pivot handle gear 50 rotatably connected to the pivot handle pivot pin 37 is coupled with a brush head gear 52 rotatably coupled to the brush head pivot pin 35. The pivot handle 36 is oriented such that the pivot handle is in an open position (i.e., a proximal end of the pivot handle is spaced from the body 22) when the brush head 26 is in an open position and the pivot handle is in a closed position (i.e., a proximal end of the pivot handle is proximate to the body) (FIG. 5) when the brush head is in a closed position. Accordingly, when the brush head 26 is biased to be in the open position, the pivot handle 36 is also biased to be in the open position. Due to the interaction of the pivot handle gear 50 and the brush head gear 52, when the pivot handle 26 is moved from the open position to the closed position, the brush head 26 simultaneous moves from the open position to the closed position.

Figure 6:
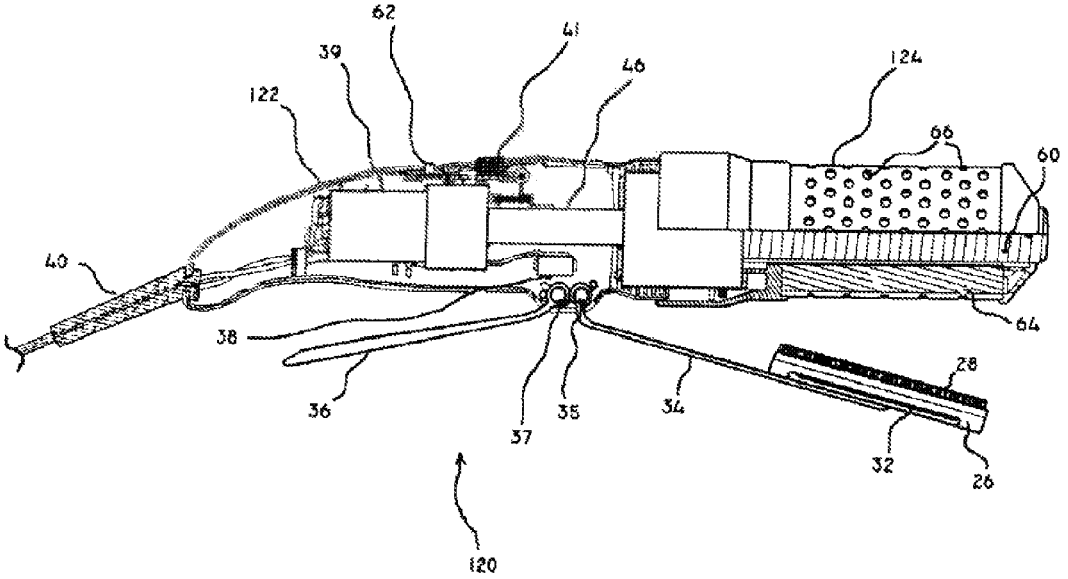
FIG. 6 is a semi-schematic, partial cross-section, side elevation view of another exemplary hair styling tool of the present invention.

Referring now to FIG. 6, another exemplary embodiment of a hair styling tool 120 includes a heating element such as a heating rod 60 which is adapted to provide heat to a cylinder 124 rotatably attached to a mounting channel similarly to the previous embodiment. The heating rod 60 may be electrically connected to a power source, such as the power cord 40, which provides the heating rod 60 with the ability to generate heat. A heating element switch 62 located on a body 122 allows a user to activate and deactivate the heating rod 60.

The cylinder 124 includes a heat transfer assembly 64 attached to an inner circumferential surface of the cylinder and adapted to allow the cylinder to slide over and make contact with the heating rod 60. The heat transfer assembly 64 may be any suitable heat transfer material, for example, plastic, metal, ceramic, or any combination thereof. Accordingly, when the heating rod 60 is heated, the heat is transferred by conduction from the heating rod to the heat transfer assembly 64 and to an exterior surface of the cylinder 124. The cylinder 124 includes holes 66, for example, concave indentations or convex protrusions, which enhance hair engagement as the cylinder rotates. In one exemplary embodiment, an exterior surface of the cylinder 124 is slightly corrugated to increase the friction between the hair and the cylinder as the cylinder rotates. Although a specific heating system, including a heat transfer assembly 64 is described to allow the heating rod 60 to conduct heat to the rotating cylinder 124, one of ordinary skill in the art will appreciate that many other similar configurations of the heating system will achieve the same result in substantially the same way, including using a radiant heating element instead of heating rod 60, which may eliminate the need for a heat transfer assembly such as 64.

Figure 7:
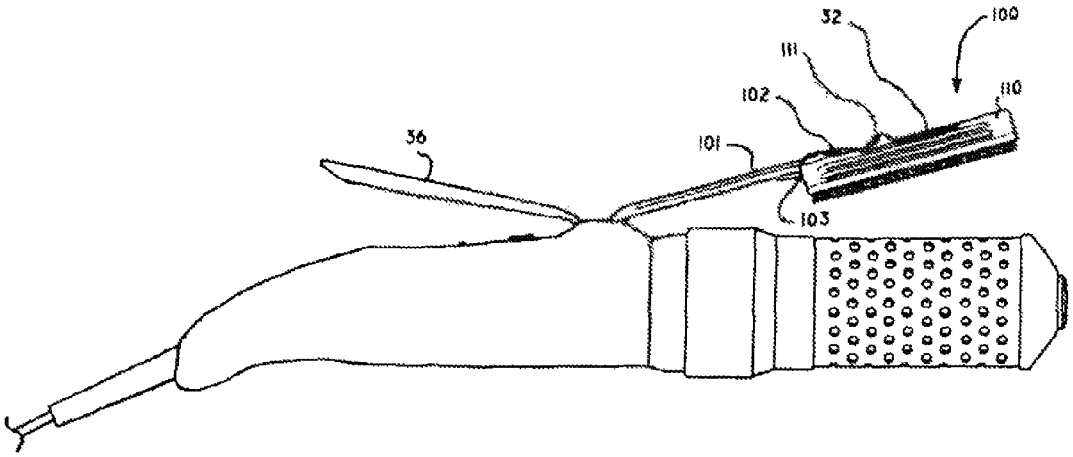
FIG. 7 is a side elevation view of yet another exemplary hair styling tool of the present invention.
Figure 8A:
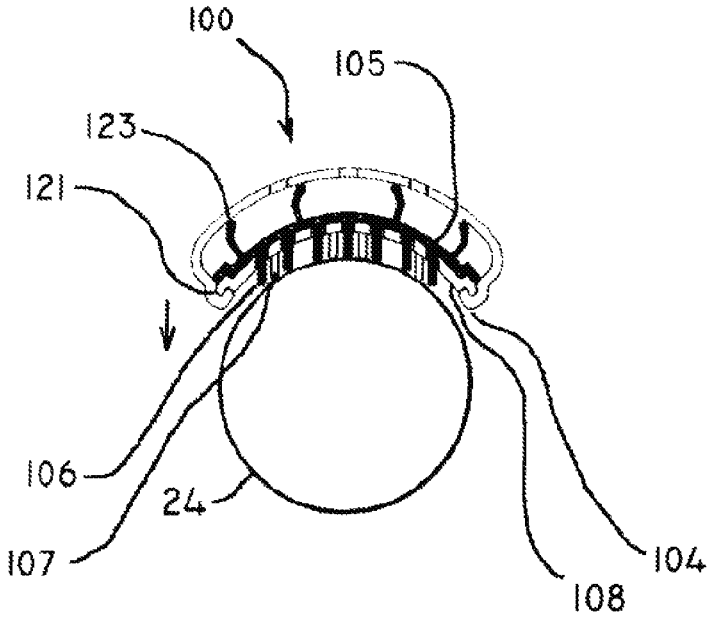
FIG. 8A is a partially schematic front view of the distal end of an exemplary hair styling tool of the present invention with compressible bristles in an extended position.
Figure 8B:
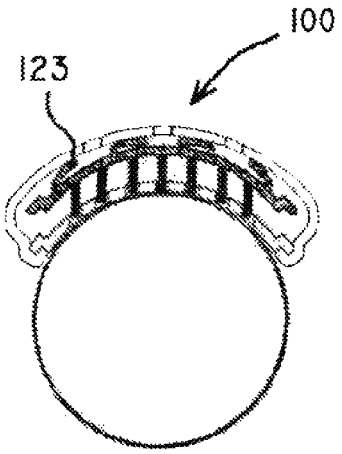
FIG. 8B is a semi-schematic front view of the distal end of FIG. 8A with the bristles in a collapsed position.
Figure 8C:
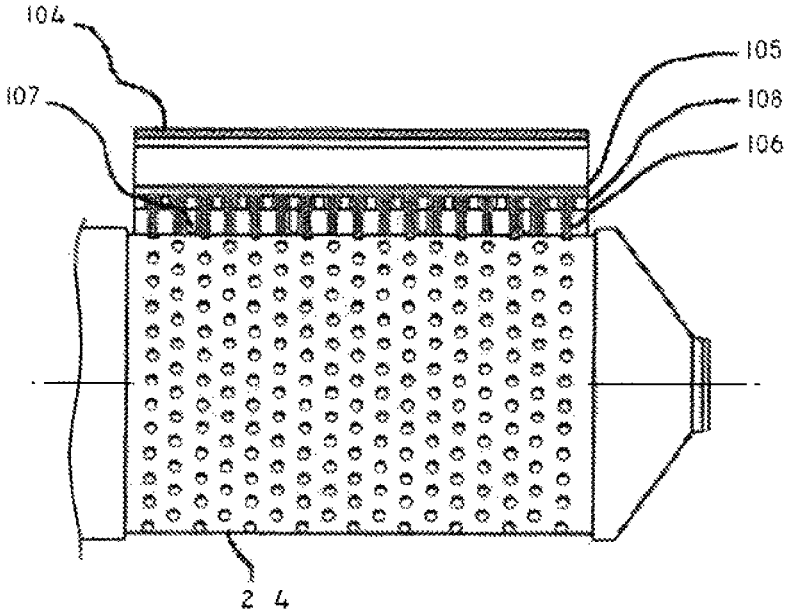
FIG. 8C is a side view of a styling arm and a cylinder of a hair styling tool of the present invention.

Referring to FIG. 7, the styling arm includes a brush head 100 having a collapsible bristle assembly. With reference also to FIGS. 8A, 8B, and 8C, the brush head 100 includes a brush head housing 104 adapted to slidingly receive the smoothing plate 108 into grooves 121 extending longitudinally along both sides of the brush head housing. The smoothing plate is heatable and in one exemplary embodiment the brush head housing may include an integrated plug electrically connected to the smoothing plate 108. When power is supplied to the plug, the plug heats the smoothing plate 108 allowing the smoothing plate to act similar to a curling iron or a straightening iron, as described in more detail below.

With further reference to FIGS. 8A-8C, the brush head housing 104 is also adapted to slidingly receive a blade 105 including bristle clusters 106 and rigid posts 107. In one exemplary embodiment, the blade 105 includes a plurality of collapsible members 123 extending longitudinally along the blade and having a generally concave cross-section. The collapsible members 123 have an extended position in which they provide for the bristles 106 to protrude from the smoothing plate 108 (FIG. 8A) and a collapsed position in which they provide for the bristles to be retracted with respect to the smoothing plate, i.e., recessed within or substantially flush with the smoothing plate (FIG. 8B). The collapsible members 123 are biased into the extended position, but may be transformed into the collapsed position by a force to overcome the bias. Specifically, when a sufficient compression force as indicated by the arrow in FIG. 8A is applied to the rigid posts 107 generally perpendicular to a planar surface of the blade 105, the collapsible members 123 bend to allow the bristles 106 and posts 107 to be recessed within the brush head housing 104 and to allow the smoothing plate 108 to have a relatively smooth surface. As such, the hair brush may also serve as a straightening iron or a curling iron.

Figure 8D:
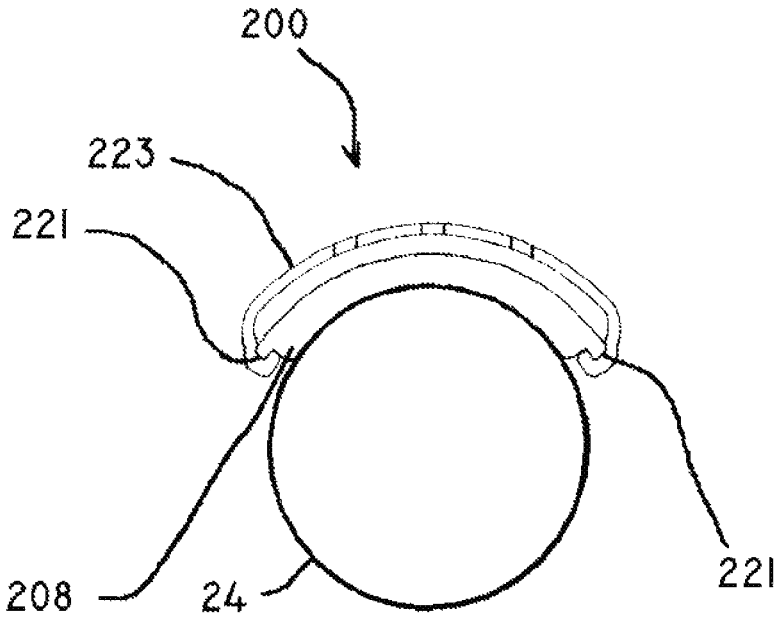
FIG. 8D is a semi-schematic front view of a distal end of a hair styling tool of the present invention having a smoothing plate without bristles.

Another exemplary embodiment of the hair styling tool is shown with respect to FIG. 8D. A styling arm 200 includes a housing 223 adapted to slidingly receive a smoothing plate 208 into grooves 221 extending longitudinally along both sides of the housing. The smoothing plate 208 does not include bristles and is heatable, and in one exemplary embodiment, the housing 223 may include an integrated plug to electrically heat the smoothing plate. When power is supplied to the plug, the heater heats the smoothing plate 208 allowing the smoothing plate to be used to more effectively style hair.

Figure 9A:
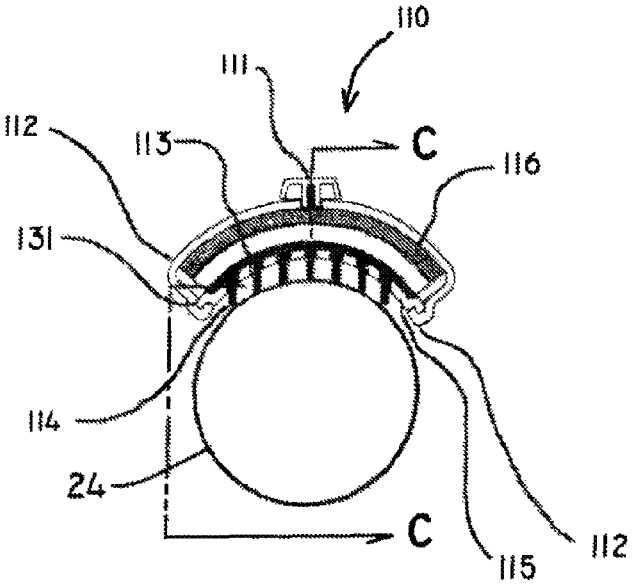
FIG. 9A is a semi-schematic front view of a distal end of a hair styling tool of the present invention with retractable bristles in the extended position.
Figure 9B:
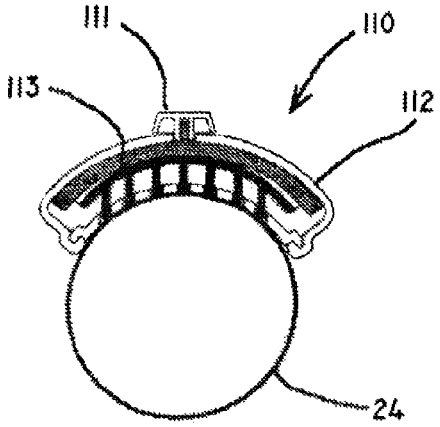
FIG. 9B is a semi-schematic front view of the distal end of FIG. 9A with retractable bristles in the collapsed position.
Figure 9C:
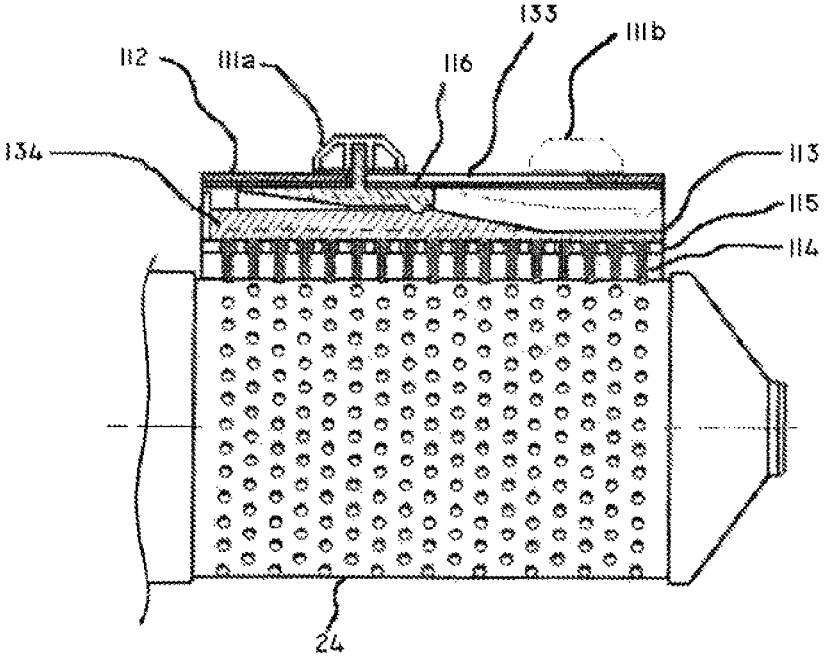
FIG. 9C is a side view of a brush head and a cylinder of a hair styling tool of the present invention.

Yet another exemplary embodiment of a brush head 110 is shown with reference to FIGS. 9A, 9B and 9C. Similarly to the brush head 100, brush head 110 includes a brush head housing 112 adapted to slidingly receive a heatable smoothing plate 115 into grooves 131 extending longitudinally along both sides of the brush head housing. The brush head housing 112 may include an integrated plug 103 electrically connected to the smoothing plate 108.

The brush head housing 112 is also adapted to slidingly receive a blade 113 including bristles 114. The brush head housing 112 includes a bristle release knob 111*a/b* adapted to be received into a release knob slot 133 located on a planar surface of the brush head housing. Specifically, with reference to FIG. 9C, a hull 116 of the release knob Ilia contacts a spine 134 of the blade 113 to place the blade in an extended position such that the bristles 114 protrude through the smoothing plate 115. The spine 134 may extend along only a portion of the blade 113. When the release knob 111*b* is slid distally along the release knob slot 133 to a release position, (i.e., a position along the blade portion absent a spine), a compression force applied generally perpendicular to a planar surface of the blade allows the bristles 114 to be recessed into the brush head housing 112 (FIG. 9B). As such, the hair brush may also be used as a curling iron or a straightening iron.

Figure 12:
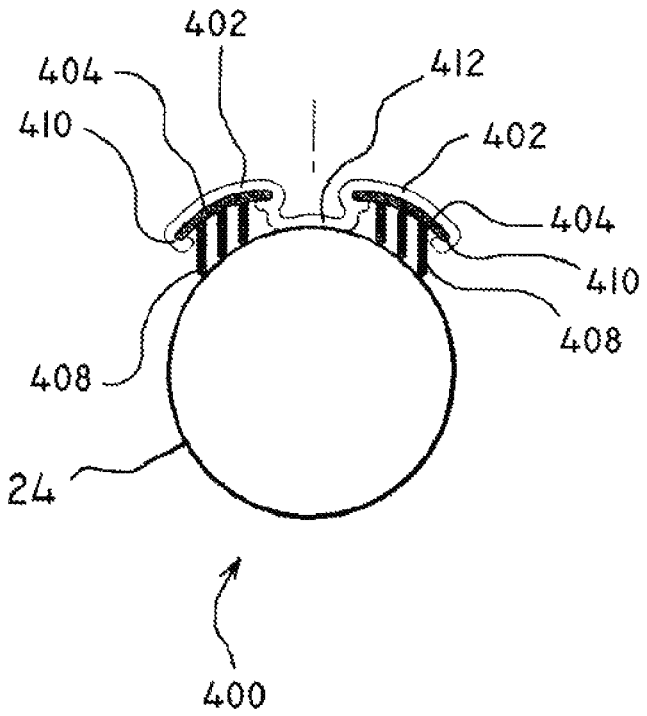
FIG. 12 is a front view of a distal end of an exemplary hair brush of the present invention having a fixed bristles brush head incorporating an integral smoothing plate.

Still another exemplary embodiment of a brush head 400 of the present invention is shown with respect to FIG. 12. The brush head 400 is directed to a brush head which incorporates a brush and an integrated smoothing plate without changing a configuration of the brush head. More specifically, the brush head 400 includes a plurality of brush head housing sections 402, each housing section adapted to slidingly receive a blade 404 including bristles 408 into grooves 410 extending longitudinally along the housing section. In one exemplary embodiment, the brush head 400 includes two housing sections 404, but the specific number of housing sections is not critical. The brush head 400 may further include a smoothing plate section 412 disposed between adjacent housing sections 404, the smoothing plate section configured to provide a planar surface contact with the cylinder 24 when the brush head is in a closed configuration as shown in FIG. 12. In one exemplary embodiment, the smoothing plate section 412 has a concave surface curved to substantially the same degree as the cylinder such that the smoothing plate section optionally can make substantially complete contact with the cylinder when the brush head is in the closed position. The brush head 400 may further include an integrated plug and heating element enabling the brush head to be electrically heated.

Figure 10:
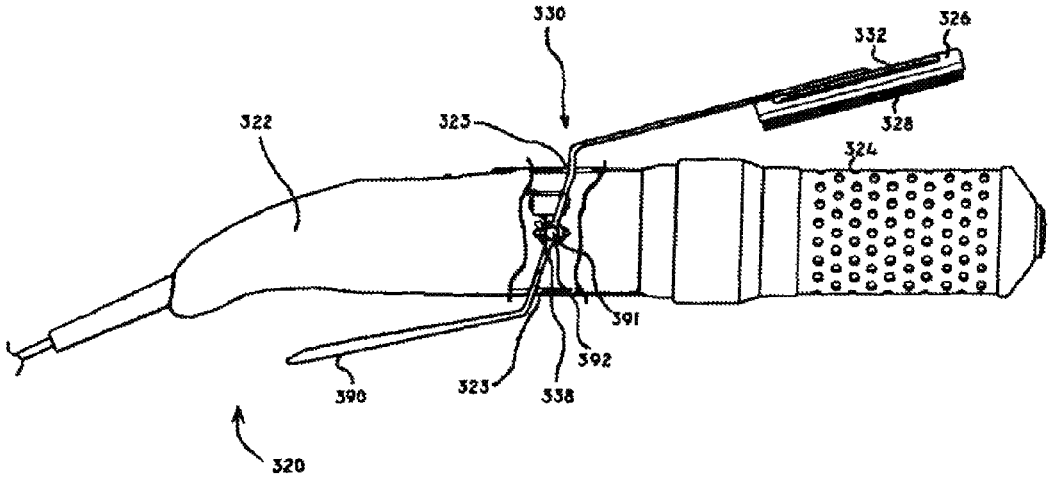
FIG. 10 is a partial cross-section, side elevation view of yet another exemplary hair styling tool of the present invention.

Another exemplary embodiment of the present invention is shown with reference to FIG. 10. A hair styling tool 320 substantially similar to the previously described hair styling tools is provided. The hair styling tool 320 includes a one-piece movable brush head assembly 330. The brush head assembly 330 includes a brush head 326 attached to a distal end of a lever arm 390. The lever arm 390 is generally in the shape of an "S" or an upside down "Z." The lever arm 390 is rotatably connected to the hair styling tool 320 by a transverse pivot pin 391. A pivot preload spring 392 biases the lever arm 390 into an open position such that the brush head 326 is spaced from a cylinder 324. When a force to overcome the spring bias is applied to the lever arm 390, the lever arm is movable from the open position to a closed position wherein the brush head 326 is proximate the cylinder 324. The body 322 of the hair styling tool 320 may include slots 323 which permit the lever arm 390 to be moved between the open position and the closed position. A cylinder rotation switch 338 may be located such that it is activated when the lever arm is in the closed position and deactivated when the lever arm is in the open position.

As will be understood by those of ordinary skill in the art, the "S" shaped lever arm configuration may also be used with any of the exemplary styling arms described above.

Figure 11:
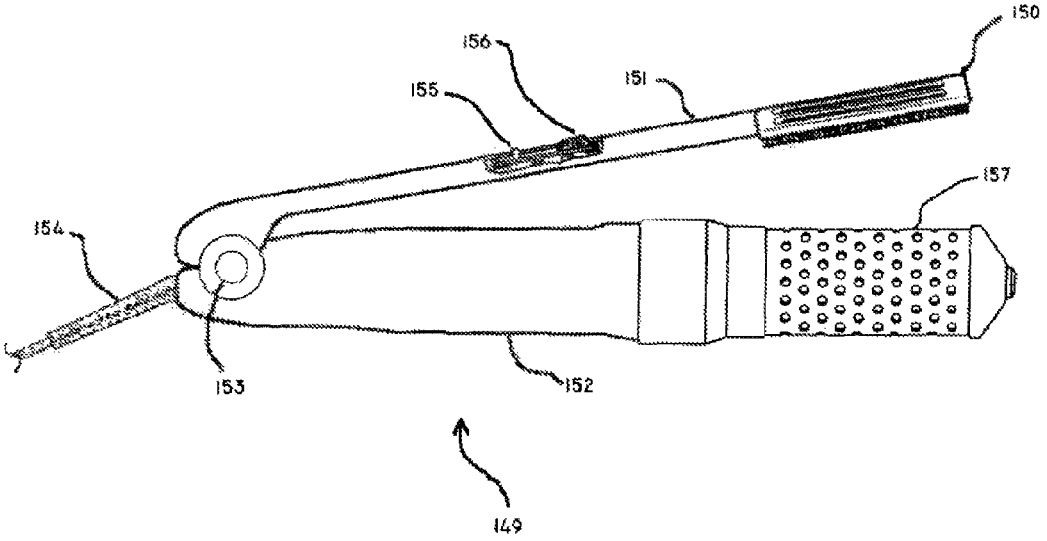
FIG. 11 is a semi-schematic side view of yet another exemplary embodiment of a hair styling tool of the present invention.

Yet another exemplary embodiment of the present invention is shown with reference to FIG. 11. A hair styling tool 149 has a hinged or "clam-shell" configuration including a body 152 and a styling arm 151 pivotally or otherwise movably attached to the body. In one exemplary embodiment, the styling arm 151 may be attached by a pivot pin 153. The pivot pin 153 may be designed so as to allow only a limited degree of rotation between the styling arm 151 and the body 152. For example, the maximum amount of rotation may about 60 degrees. Similarly to the previously described hair styling tool embodiments, the body 152 includes a rotatable cylinder 157 and the styling arm 151 includes a brush head 150. In one exemplary embodiment, a heating element switch 155 to control heating of the cylinder 157 and the brush head 150, and a rotation switch 156 to control rotation of the cylinder are located on the styling arm 151. However, the location of such switches is not critical, and the switches may be located anywhere that is convenient for user access. The hair styling tool 149 may be electrically powered through a power cord 154.

In one exemplary embodiment, the styling arm 151 may be biased, for example, by a spring, into an open position such that the styling arm is distant from the cylinder and not in contact with the cylinder 24. A force to overcome the bias may be applied to the styling arm 151 to place the styling arm in a closed position wherein the styling arm is proximate to the cylinder.

Figure 5:
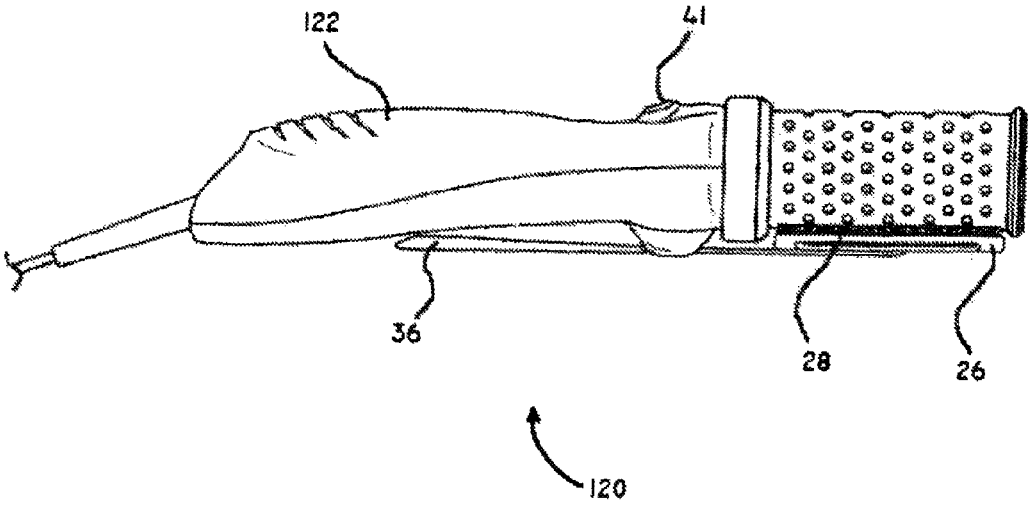
FIG. 5 is a side view of an exemplary hair styling tool of the present invention with a styling arm in the closed position.

The operation and use of the hair styling tool 20 will now be described with reference to FIGS. 1 and 5. The hair styling tool may be used by placing a selected portion of hair between the brush head 26 and the cylinder 24 when the brush head is in the open position (FIG. 1). The pivot handle 36 may then be moved from the open position to the closed position, resulting in the simultaneous movement of the brush head 26 from its open position to its closed position. Placing the brush head 26 in the closed position allows the brush head to clamp the selection portion of hair between the cylinder 24 and the bristles 28 of the brush head. Additionally, in one exemplary embodiment, placing the pivot handle 36 in the closed position triggers the rotation switch 38 to activate rotation of the cylinder 24. Accordingly, almost any length of hair may be brushed, shaped and styled without significant tangling in this manner. As is apparent, the various other exemplary embodiments of the hair styling tools described may be used in a similar manner. Namely, hair may be placed between the styling arm and the cylinder when the styling arm is in the open position. Once the hair is in place, the styling arm may be moved to the closed position to capture and style the hair. In an exemplary embodiment where the rotation direction of the cylinder is reversible, a user can use the brush with either hand or from either side of the head while having the cylinder rotate in the same general direction with respect to the hair.

The brushing, shaping and styling effects may be enhanced by using the heat apparatus associated with exemplary embodiments of the brush. Specifically, the hot air fan assembly 44 or the heating rod may be activated to heat the cylinder 24 as it rotates. Additionally or alternatively, the heatable smoothing plates 108, 115, 208 or 412 of the brush heads 100, 110, 200 or 400 may be heated. The heat applied to the hair by the cylinder 24 and/or the brush heads 100, 110, 200 or 400 not only allows the hair to dry more quickly, but also provides the hair with smoothing volume and a healthy shine.

With reference to FIGS. 8A-8C, if a user wants to use the device as a curling iron or a flat iron, a compression force generally perpendicularly to the smoothing plate 108 may be applied to the blade 105 to place the bristles 106 in the collapsed position. In the collapsed position, the bristles 106 of the brush head are retracted with respect to the smoothing plate 108, i.e. recessed within or flush with the smoothing plate. Accordingly, the smoothing plate will have a smooth surface which, along with heat provided through the cylinder 24 and/or through the brush head, allows the device to be used as a smoothing, straightening or curling iron. In an alternate embodiment with reference to FIGS. 9A-9C, the user slides the release knob 111 distally along the slot 133 from position Ilia to position 111*b* such that the spine 134 of the blade 113 does not make contact with the hull 116 of the release knob 111. Then, the user can apply a compression force to the blade 113 to cause ends of the bristles 114 to be retracted with respect to the smoothing plate.

With reference to FIGS. 11 and 12, the combination of bristle clusters 408 fixed in relationship to the heated flat iron section 412 allows the user to simultaneously brush and smooth, straighten or curl hair without having to change a configuration of the brush head 400.

Figure 13:
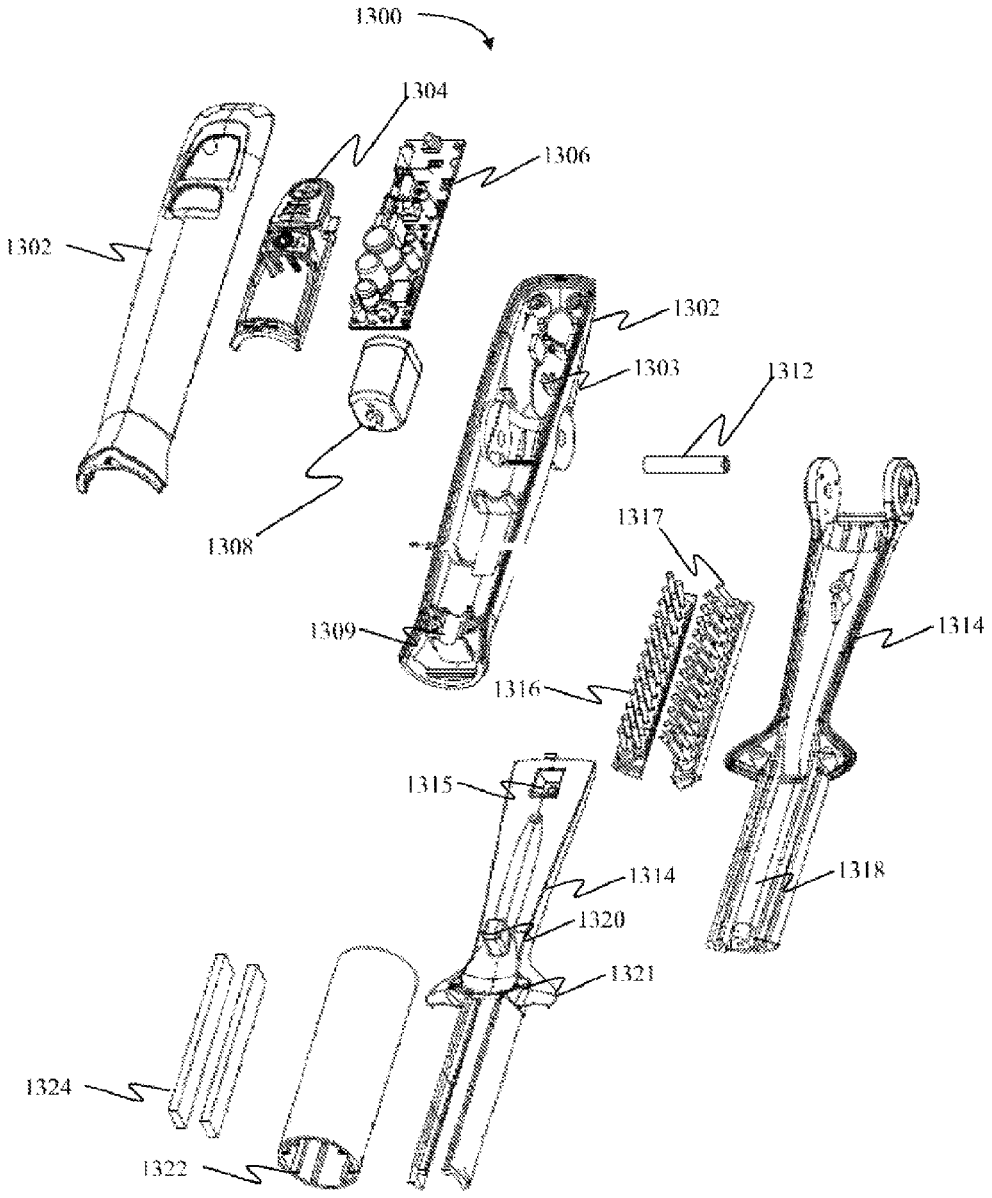
FIG. 13 is a perspective exploded view of another exemplary embodiment of a tool suitable for hair styling.

With reference to FIG. 13, a tool 1300 suitable for hair styling comprises an elongated body 1302 having a proximal end and a distal end that houses an actuator 1304, a control circuit 1306 and a motor 1308. The circuit 1306 can include a microswitch activated by the actuator 1304. A cylinder 1322 is rotatably attached to the elongated body 1302 for polishing the user's hair. Optionally the cylinder 1322 can have one or more heaters 1324 to increase the polishing effect on a user's hair when using the tool 1300. The heater 1324 can be a PTC (positive temperature coefficient) ceramic heating element commonly used in curling irons. A non-rotatable styling arm 1314 is pivotally attached to the elongated body 1302 with a pivot mechanism 1312. The styling arm 1314 can move between an open position distant from the cylinder 1322 and a closed position proximate to the cylinder 1322. A biasing means such as, for example, a spring, can be used for biasing the styling arm into the open position. The styling arm 1314 can also have a heater to increase the effectiveness of the styling tool.

The tool 1300 also has a spacing means 1320, such as, for example, an adjustable screw, a projection on the styling arm 1314, or a fixed plastic stop among others, positioned to engage a detent 1309 in the body 1302 or a spacing arm 1321 for preventing prevents the styling arm 1314 from overloading the motor, such as by preventing the styling arm 1314 from contacting the cylinder 1322. Alternatively, the stop can be on the body and the detent on the styling arm. The distance between the cylinder 1322 and the styling arm 1314 can be between 0.001 mm and 0.5 mm. In a particularly preferred embodiment, the distance is 0.3 mm.

Preferably, the motor 1308 has current overload protection as is known in the art. If current drawn by the tool 1300 exceeds a target level, such as, for example, 7 amps of current provided from a standard electrical socket, or if too much current is being drawn by the tool 1300, the command circuit 1306 can intermittently turn off motor 1308 or deactivate the tool 1300 completely, like a fuse, as a safety precaution. For example, an excessive current load can happen from a short circuit in a heating element, or from a user clamping the tool 1300 down on the hair with too much pressure, thereby bypassing the spacing means 1320, and causing the styling arm 1314 and the cylinder 1322 to forcefully contact one another.

The styling arm 1314 can have interchangeable brush heads 1316 and 1317, at its distal end for evenly spacing the user's hair between the styling arm 1314 and the cylinder 1322. The brush heads 1316 and 1317 can each have a plurality of bristles and variety of bristles to suit the hair type of the user. For example, a user with coarser hair can use larger bristle brush heads 1316 and 1317 to more easily move through the coarse hair. In another embodiment, the brush heads 1316 and 1317 also have a bristle release knob (not shown) with a first and second position to move the bristles 1317 into the extended position in the first knob position, and to collapse the bristle 1317 in the second knob position.

In another embodiment, a smoothing plate 1318 can be located between the brush heads 1316 and 1317. The smoothing plate 1318 has a curved concave surface, substantially the same as the cylinder 1322, to maximize the effectiveness of the smoothing plate 1318 and the rotating cylinder 1322. In one embodiment, at least some of the bristles 1316 and 1317 can extend beyond the smoothing plate 1318. In yet another exemplary embodiment, the bristles 1316 and 1317 are movable between an extended position protruding past the smoothing plate 1318 and a collapsed position in which the bristles 1316 and 1317 are retracted with respect to the smoothing plate 1318. The smoothing plate can be heated with a PTC ceramic heater similar to the heater 1324 used for the cylinder 1323.

In one embodiment, the actuator 1304 can be used to turn the optional cylinder heater 1324 on or off and can turn the motor 1308 on or off to rotate the cylinder 1322 relative to the body in a clockwise or counter-clockwise direction. In a preferred embodiment, a control circuit 1306 can automatically detect the direction of movement of the styling arm 1314 along a user's hair when the styling arm 1314 is in a closed position and automatically rotate the cylinder 1322 in the correct direction. Optionally, the styling arm 1314 can have a projection 1315 that can engage a switch detent 1303 in the body 1302 that can signal the control circuit 1306 to automatically rotate the cylinder 1322 when the user places the styling arm 1314 in the closed position.

Figure 14:
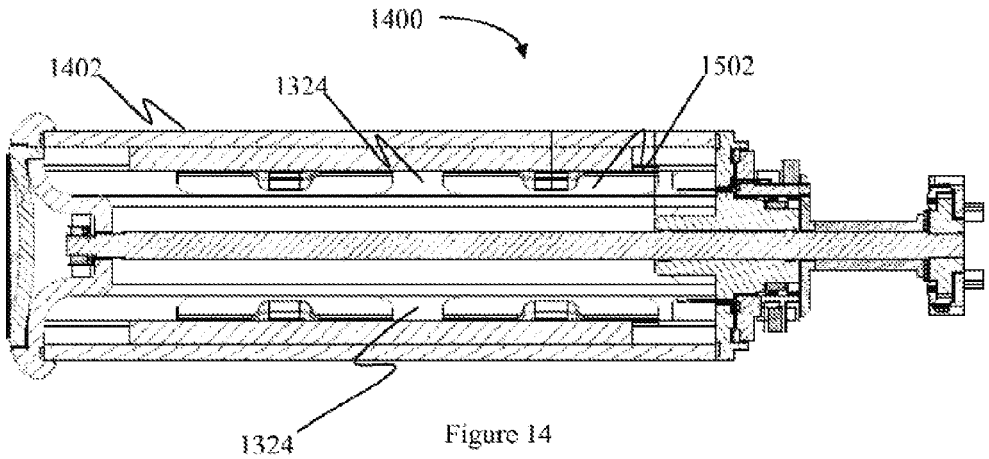
FIG. 14 is a cross-sectional view of a cylinder useful for styling hair according to one embodiment of the present invention.
Figure 15:
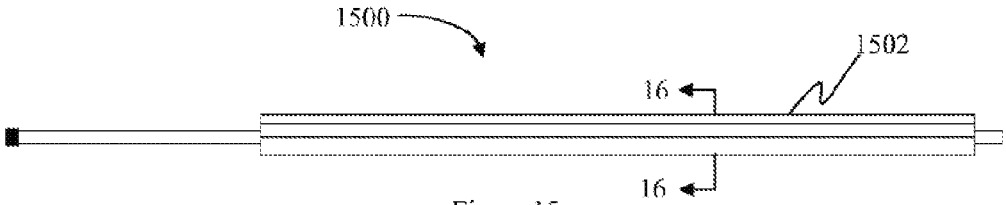
FIG. 15 is a diagram of a direction detecting device according to one embodiment of the present invention.

With reference to FIG. 14, there is shown a cross sectional view of a cylinder 1400 useful for styling hair. The surface 1402 of the cylinder 1400 polishes hair shafts as they pass over the cylinder 1400. When heating elements 1324 and the cylinder are rotated, a consistent amount of heat is applied that amplifies the polishing effect on the hair. The cylinder 1400 can be manually or automatically set to rotate and to heat according to various embodiments. The interchangeable brush heads 1316 and 1317 distribute the hair shafts evenly over the surface 1402 of the cylinder 1400 to decrease the time required to polish and style the users hair.

Figure 16:
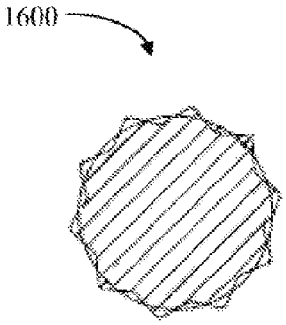
FIG. 16 is a cross-sectional view of the direction detecting device of FIG. 15.
Figure 17:
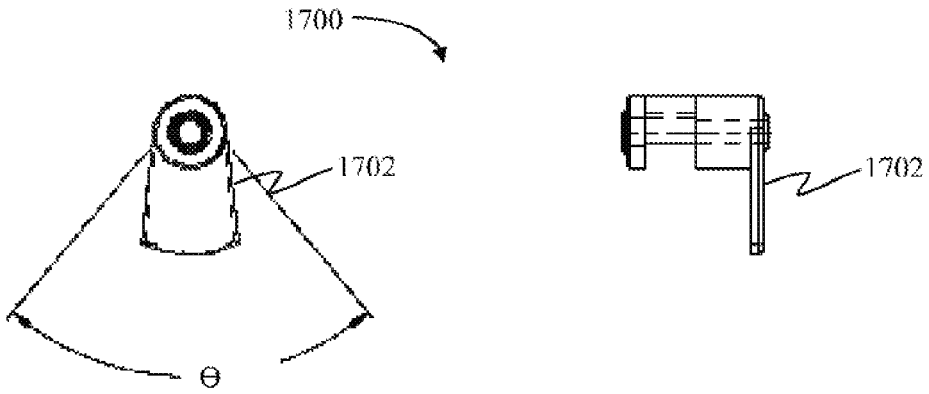
FIG. 17 is a diagram of a mechanical detector for detecting the direction of movement of the styling arm in another exemplary embodiment of the present invention.
Figure 18:
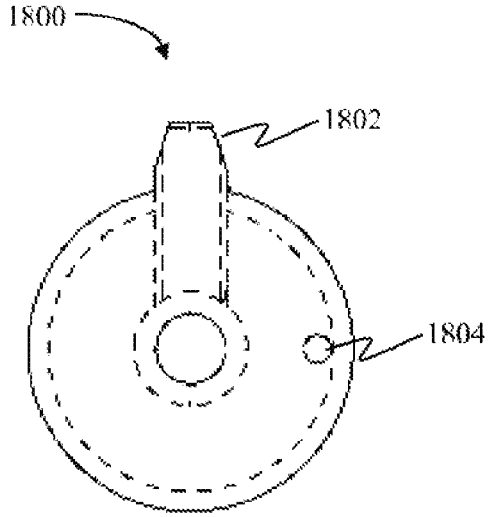
FIG. 18 is a diagram of an opto-electronic detector for detecting the direction of movement of the styling arm in another exemplary embodiment of the present invention.

With reference to FIGS. 15, 16, 17 and 18, there is shown a diagram of a direction detecting device 1500 and a cross sectional view of another direction detecting device 1600, a diagram of a mechanical actuator 1700 and an opto-electronic actuator 1800, respectively, for detecting the direction of movement of the styling arm. The detectors 1500 and 1600 sense the direction of movement of the styling arm 1314 along a user's hair as the user draws the styling tool 1300 from the root of the hair down to the end of the hair. A ridge 1502 gently contacts the hair that has been placed between the styling arm 1314 and the cylinder 1322 and turns with the drawing down motion of the tool 1300. One or more actuators 1700 and 1800 coupled to the detectors 1500 or 1600 trigger the command circuit 1306 to drive the motor 1308 and rotate the cylinder 1322 in a clockwise or counter-clockwise direction corresponding to the direction of movement of the styling arm along the user's hair. The direction detecting device 1500 can be spring loaded into the styling arm 1314 of the hair styling tool 1300 to engage the surface of the user's hair as the hair styling tool 1300 is moved through the user's hair. The direction detecting device 1500 can have a ridge 1502 that can rotate in either direction and that is sized so that the ridge 1502 engages the user's hair when the hair styling tool 1300 is in the closed position. In another embodiment, the direction detecting device 1500 can have multiple ridges as shown in FIG. 16.

The mechanical actuator 1700 has a tab 1702 that contacts one or more switches connected to the control circuit 1306 to drive the motor 1308 in the correct direction to style the user's hair without tangling. The actuator 1700 and movable between a first position corresponding to clockwise rotation of the cylinder and a second position corresponding to counterclockwise rotation of the cylinder; and a position sensor for sensing the position of the actuator.

The opto-electronic actuator 1800 comprises an actuator tab 1802 that interrupts one or more light beam sensors 1804 that causes the control circuit 1306 to drive the motor 1308 in the correct direction to style the user's hair without tangling. As can be appreciated, there are many mechanical, electrical, magnetic and optical methods that can be used in various embodiments to detect and actuate the direction of motion of the hair styling tool 1300 as will be understood by those with skill in the art with reference to this disclosure.

Figure 19:
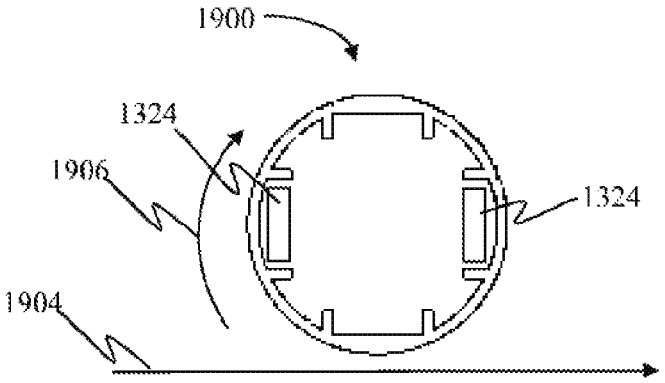
FIG. 19 is a cross-sectional view of the cylinder and the styling arm of FIG. 13.

With reference to FIG. 19, there is shown a cross section view 1900 of the cylinder 1322 and the styling arm 1314. When the user's hair moves along a direction shown by vector 1904, the styling arm 1314 moves in a direction indicated by the vector 1906. The detectors 1700 and 1800 are adapted to cause the motor to rotate the cylinder in a direction such that the cylinder at its 3 o'clock position has a motion vector in substantially the same direction as movement of the styling arm along the user's hair. Rotation of the cylinder 1322 does not result in the user's hair being snagged or tangled by the rotating cylinder 1322 or the styling arm, 1314.

In another embodiment, there is provided a method to style a person's hair using the styling tool 1300. The user can style their hair by (1) selecting the tool 1300, (2) turning on the switch 1304 and allowing the heater to heat the cylinder 1322, the styling arm 1314 or both the cylinder 1322 and the styling arm 1314, (3) placing the user's hair between the cylinder 1322 and the styling arm 1314 near the scalp with the styling arm 1314 in an open position, (4) moving the styling arm 1314 to a closed position thereby causing the switch 1303 to activate the motor 1308 to rotate the cylinder 1322 and while the cylinder 1322 is rotating, and (5) styling the hair by pulling the tool toward the tips of the hair.

Various embodiments of brush heads, cylinders, and configurations of the hair brush have been described herein and, as will be appreciated by one of ordinary skill in the art, different brush heads and/or blades may be used with the different hair styling tools. Moreover, additional interchangeable brush heads or blades may be provided as a kit along with the base hair styling tool. Additionally, although specific means and configurations have been described, it will be appreciated that modifications may be made to such means and configurations while still remaining within the scope of the appended claims.

What is claimed is:

1. A hair styling device comprising:

a) first and second arms, each arm having a distal end and a proximate end, the arms pivotably connected together at their proximate ends to pivot from an open position toward a closed position for hair styling;

b) a rotatable member supported by the first arm for engaging hair, the second arm being non-rotatable with respect to the first arm;

c) a motor for rotating the rotatable member in the closed position, wherein the motor can rotate the rotatable member both in clockwise and counterclockwise directions;

d) a controller that can be triggered for automatically controlling the motor to rotate in a clockwise or counterclockwise direction for rotating the rotatable member in a clockwise or counterclockwise direction in the closed position;

e) a switch for automatically causing the rotatable member to rotate as the arms are moved to the closed position from the open position; and f) biasing means for biasing the first and second arms into the open position.

2. The device of claim 1, wherein the controller can stop the motor from rotating the rotatable member in the closed position.

3. The device of claim 1, wherein the motor is reversible by the controller.

4. The device of claim 1, wherein the biasing means comprise a spring.

5. The device of claim 1, further comprising a microswitch for the controller.

6. The device of claim 5, further comprising an actuator for activating the microswitch.

7. A method to style a person's hair comprising the steps of:

(a) grasping the hair styling device of claim 1;

(b) placing the hair between the first and second arms with the arms in the open position;

(c) moving the first and second arms to the closed position and causing the motor to rotate the rotatable member; and (d) after step (c), pulling the hair styling device away from the person's head, thereby styling the hair.

8. A hair styling device comprising:

a) first and second arms, each arm having a distal end and a proximate end, the arms pivotably connected together at their proximate ends to pivot from an open position toward a closed position for hair styling;

b) a rotatable member supported by the first arm for engaging hair, the second arm being non-rotatable with respect to the first arm;

c) a motor for rotating the rotatable member in the closed position, wherein the motor can rotate the rotatable member both in clockwise and counterclockwise directions;

d) a switch for automatically causing the rotatable member to rotate as the arms are moved to the closed position from the open position;

e) a heater for heating the hair in the closed position;

f) a controller that can be triggered for automatically controlling the motor to rotate in a clockwise or counterclockwise direction for rotating the rotatable member in a clockwise or counterclockwise direction in the closed position, wherein the controller comprises a microswitch, the device comprising an actuator for activating the microswitch; and g) biasing means for biasing the first and second arms into the open position.

9. The device of claim 8, wherein the actuator turns the heater off and on.

10. The device of claim 8, wherein the controller can stop the motor from rotating the rotatable member in the closed position.

11. The device of claim 8, wherein the motor is reversible by the controller.

12. A tool suitable for hair curling comprising:

(a) a body having a longitudinal axis, a proximate end, and a distal end;

(b) a rotatable member supported by the body, the rotatable member being rotatable relative to the body for engaging hair;

(c) a pivoting arm that does not rotate with respect to the body and is pivotally attached to the body at a location closer to the proximate end of the body than the distal end of the body, the pivoting arm having a distal end consisting of non-rotatable elements, wherein the pivoting arm is movable between an open position and a closed position sufficiently close to the rotatable member to allow for hair curling in the closed position;

(d) at least one heater supported by the body for heating the hair in the closed position;

(e) an electric motor able to rotate the rotatable member both in clockwise and counterclockwise directions, the motor located in the body, wherein the rotatable member is rotatable by the motor in the closed position without any part of the pivoting arm rotating;

(f) a switch adapted to automatically cause the motor to rotate the rotatable member by placement of the pivoting arm into the closed position;

(g) a command circuit that can be triggered for automatically controlling the rotation of the motor both in the clockwise and counterclockwise direction for rotating the rotatable member in a clockwise or counterclockwise direction; and (h) a spring for biasing the pivoting arm to the open position.

13. The tool of claim 12, wherein the command circuit stops the rotation of the motor in response to the tool drawing current exceeding a target level.

14. The tool of claim 12, wherein the command circuit can deactivate the tool in response to the tool drawing current exceeding a target level.

15. The tool of claim 12, wherein the command circuit includes a microswitch.

16. The tool of claim 15 having an actuator, wherein the microswitch is activated by the actuator.

17. The tool of claim 12, further comprising a spacer that prevents the pivoting arm from overloading the motor.

18. The tool of claim 17, wherein the spacer is on the body for engaging the pivoting arm or on the pivoting arm for engaging the body.

19. A method to self-curl hair comprising the steps of:

(a) grasping the tool of claim 12;

(b) placing the hair at the rotatable member with the pivoting arm in the open position;

(c) after step (b) moving the pivoting arm to the closed position and causing the motor to continuously rotate the rotatable member; and (d) after step (b) heating the hair in the closed position for curling the hair.

20. The tool of claim 12 wherein the command circuit is capable of intermittently turning off the motor in the closed position.

21. A tool suitable for hair curling comprising:

(a) a body having a longitudinal axis, a proximate end, and a distal end;

(b) a rotatable member supported by the body, the rotatable member being rotatable relative to the body for engaging hair;

(c) a pivoting arm that does not rotate with respect to the body and is pivotally attached to the body at a location closer to the proximate end of the body than the distal end of the body, the pivoting arm having a distal end consisting of non-rotatable elements, wherein the pivoting arm is movable between an open position and a closed position sufficiently close to the rotatable member to allow for hair curling in the closed position;

(d) at least one heater supported by the body for heating the hair in the closed position;

(e) an electric motor able to rotate the rotatable member both in clockwise and counterclockwise directions, the motor located in the body, wherein the rotatable member is rotatable by the motor in the closed position without any part of the pivoting arm rotating;

(f) a switch adapted to automatically cause the motor to rotate the rotatable member by placement of the pivoting arm into the closed position;

(g) a command circuit that can be triggered for automatically controlling the rotation of the motor both in the clockwise and counterclockwise direction for rotating the rotatable member in a clockwise or counterclockwise direction in the closed position, wherein the command circuit is capable of turning off the motor in the closed position; and (h) a spring for biasing the pivoting arm into the open position.

22. The tool of claim 21 wherein the command circuit stops the rotation of the motor in response to the tool drawing current exceeding a target level.

23. The tool of claim 21 wherein the command circuit can deactivate the tool in response to the tool drawing current exceeding a target level.

24. The tool of claim 21 wherein the command circuit includes a microswitch.

25. The tool of claim 24 having an actuator, wherein the microswitch is activated by the actuator.

26. The tool of claim 21 wherein the command circuit is capable of intermittently turning off the motor in the closed position.

27. A tool suitable for hair curling comprising:

(a) a body having a longitudinal axis, a proximate end, and a distal end;

(b) a rotatable member supported by the body, the rotatable member being rotatable relative to the body for engaging hair;

(c) a pivoting arm that does not rotate with respect to the body and is pivotally attached to the body at a location closer to the proximate end of the body than the distal end of the body, the pivoting arm having a distal end consisting of non-rotatable elements, wherein the pivoting arm is movable between an open position and a closed position sufficiently close to the rotatable member to allow for hair curling in the closed position;

(d) a heater supported by the body for heating the hair in the closed position;

(e) an electric motor able to rotate the rotatable member both in clockwise and counterclockwise directions, the motor located in the body, wherein the rotatable member is rotatable by the motor in the closed position without any part of the pivoting arm rotating;

(f) a switch adapted to automatically cause the motor to rotate the rotatable member by placement of the pivoting arm into the closed position;

(g) a command circuit that can be triggered for automatically controlling the rotation of the motor both in the clockwise and counterclockwise direction for rotating the rotatable member in a clockwise or counterclockwise direction in the closed position;

(h) a spring for biasing the pivoting arm into the open position; and (i) overload protection for the motor.

28. The tool of claim 27 wherein the command circuit includes a microswitch.

29. The tool of claim 28 having an actuator, wherein the microswitch is activated by the actuator.

30. The tool of claim 27 wherein the command circuit is capable of intermittently turning off the motor in the closed position.

31. A hair curling device comprising:

a) first and second arms, each arm having a distal section and a proximate section, the arms pivotably connected together at their proximate sections to pivot from an open position toward a closed position for hair curling;

b) a means for biasing the first and second arms into the open position;

c) a rotatable member supported by the first arm for engaging hair, the second arm being non-rotatable with respect to the first arm;

d) a motor for rotating the rotatable member in the closed position, wherein the motor can rotate the rotatable member both in clockwise and counterclockwise directions;

e) a switch for automatically causing the rotatable member to rotate as the arms are moved to the closed position from the open position;

f) a heater for heating the hair in the closed position; and g) a command circuit that can be triggered for automatically controlling the rotation of the motor both in the clockwise and counterclockwise directions for rotating the rotatable member in a clockwise or counterclockwise direction in the closed position.

32. A method to self-curl hair comprising the steps of:

(a) grasping the hair curling device of claim 31;

(b) placing the hair between the first and second arms with the arms in the open position;

(c) after step (b) moving the rotatable member to the closed position thereby causing the motor to rotate the rotatable member due to the action of the switch;

(d) heating the hair in the closed position for curling the hair; and (e) pulling the hair curling device away from the curled hair.

* * * * *